United States Patent [19]

Götz et al.

[11] Patent Number: 4,827,988

[45] Date of Patent: May 9, 1989

[54] FOAMING APPARATUS FOR DRIVING OUT RESIDUAL AIR FROM CONTAINERS FILLED WITH A FOAMABLE LIQUID

[75] Inventors: Rainer Götz, Pfaffen-Schwabenheim; Gerhard Pfeiffer, Norheim; Paul Knodel, Hochstätten; Willi Scheid, Sobernheim; Ludwig Clüsserath, Bad Kreuznach, all of Fed. Rep. of Germany

[73] Assignee: Seitz Enzinger Noll Maschinenbau Aktiengesellschaft, Mannheim, Fed. Rep. of Germany

[21] Appl. No.: 118,289

[22] Filed: Nov. 6, 1987

[30] Foreign Application Priority Data

Nov. 12, 1986 [DE] Fed. Rep. of Germany ..... 3638601

[51] Int. Cl.[4] ..... B67C 3/22

[52] U.S. Cl. ..... 141/167; 141/59; 141/69; 141/103

[58] Field of Search ..... 141/4, 6, 59, 61, 52, 141/65, 69, 66, 70, 129, 177, 178, 179, 103; 53/510, 432

[56] References Cited

U.S. PATENT DOCUMENTS

| | | | |
|---|---|---|---|
| 3,670,786 | 6/1972 | Levin et al. | 141/92 |
| 4,514,953 | 5/1985 | Patzwahl | 141/70 X |
| 4,602,473 | 7/1986 | Hayashi et al. | 53/510 |
| 4,662,154 | 5/1987 | Hayward | 53/510 X |
| 4,693,054 | 9/1987 | Spargo | 141/6 |

FOREIGN PATENT DOCUMENTS

| | | | |
|---|---|---|---|
| 2615429 | 10/1977 | Fed. Rep. of Germany | 141/4 |
| 3311200 | 4/1984 | Fed. Rep. of Germany . | |
| 151918 | 11/1981 | German Democratic Rep. | 141/4 |

*Primary Examiner*—Ernest G. Cusick

*Attorney, Agent, or Firm*—Becker & Becker Inc.

[57] ABSTRACT

A foaming apparatus for driving out residual air from containers, especially bottles, that are filled with liquid material that can foam. The apparatus has a nozzle mechanism that cooperates with a control device and is disposed above a conveying section. To foam the material in the containers and to drive out the residual air from the latter as they move past below the nozzle mechanism, the latter is provided with a plurality of individual nozzles that in the conveying direction of the conveying section are fixedly disposed one after the other above the path of movement of the containers, with the spray nozzles being adapted to communicate with a common supply channel for the medium that induces foaming. Each spray nozzle is furthermore provided with a separately controllable control valve for establishing the communication of the spray nozzles with the supply channel. The control valves are operatively connected to a control device in such a way that the latter can select and open at least one control valve as a function of the conveying speed of the conveying section.

8 Claims, 4 Drawing Sheets

FIG-3
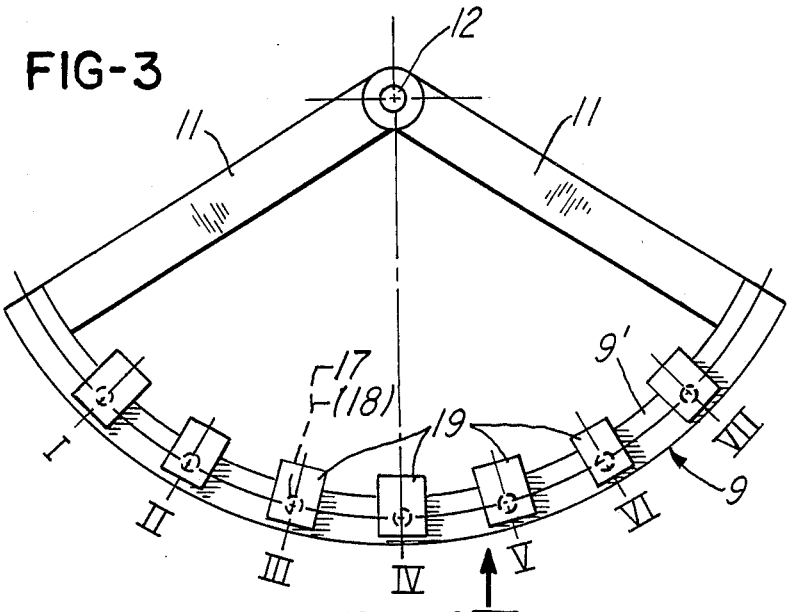
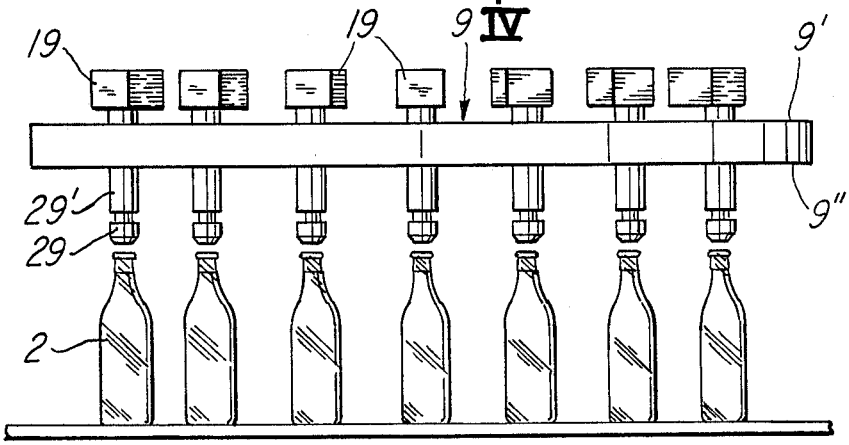
FIG-4

FOAMING APPARATUS FOR DRIVING OUT RESIDUAL AIR FROM CONTAINERS FILLED WITH A FOAMABLE LIQUID

BACKGROUND OF THE INVENTION

1. Field of the Invention

The present invention relates to a foaming or effervescing apparatus for driving out the residual air from containers, especially bottles, that are filled with liquid material that can foam or effervesce. The apparatus includes a nozzle mechanism that is disposed above a conveying section or means that feeds the not-yet-sealed containers, which are filled with the foamable material, in an upright state to a sealing device that is provided with a sealing station. At a spraying station that in the conveying direction of the conveying means is located prior to the sealing station, the nozzle mechanism introduces a stream of gaseous or liquid medium that induces foaming; this involves preferably a stream of water or a stream of the liquid material with which the containers are filled, introduced into the liquid material in those containers that move past below the nozzle mechanism for the purpose of foaming the liquid material in the containers and driving out the residual air in those containers via the thus-formed foam. The foaming apparatus also includes a control device for varying the distance of the spraying station from the sealing station as a function of the conveying speed of the conveying means.

2. Description of the Related Art

An apparatus of the aforementioned general type is known from German Pat. No. 33 11 200—Patzwahl dated Apr. 5, 1984, which corresponds to U.S. Pat. No. 4,514,953—Patzwahl dated May 7, 1985, and, when a foamable liquid material, especially beer, is dispensed into containers, is used, prior to sealing the containers, to drive out, via foaming of the liquid material, the residual air that is present in the bottles after the liquid is dispensed therein. This prevents impairment of the taste and life of the dispensed material.

With the heretofore known apparatus, to foam the liquid material, i.e. to drive out the residual air, each container that is filled with material and is disposed on the conveying means that feeds the containers to the sealing station of the sealing device, is conducted past below a single spray nozzle that forms the nozzle mechanism. From this single spray nozzle, a stream of a liquid that induces foaming is sprayed into the container, so that the material dispensed in the container is stimulated to form foam, whereby the residual quantity of air is driven out by this foam. For an optimum foaming, it is desirable that the material foam, i.e. the head formed by this foam, reach the upper mouth of the container when the pertaining container reaches the sealing station, where it is capped and sealed. Since it is undesirable not only to have too great of a foaming action, or any foaming at all, due to the losses of material that occur and the contamination of the sealing station, but also to have too little of a foaming action due to the insufficient driving-out of the residual air from the pertaining container, the time (foaming time) between the time the liquid that induces foaming is sprayed in and the sealing of the pertaining container must be optimally selected. This means that the distance of the spraying position at which the liquid that induces foaming is sprayed into the pertaining container from the sealing station must be set as a function of the conveying speed of the conveying means in conformity with the optimum foaming time, and in particular must be adjusted in such a way that the spray nozzle, i.e. the spraying position, must have a lesser distance from the sealing station at lower conveying speeds of the conveying means than at greater conveying speeds of the conveying means. In order to achieve this, with the heretofore known apparatus the spray nozzle is provided at the free end of a support arm that is pivotable about the axis of rotation of a transport star that forms the conveying means and that rotates synchronously with a filling machine that is connected ahead of it. Thus, by pivoting the support arm, the spray nozzle can be adjusted along the conveying means.

One drawback of this heretofore known configuration is that mechanically movable parts are required for adjusting the distance of the spraying position from the sealing station; these movable parts entail a relatively expensive and complicated construction that is particularly susceptible to failure. A further drawback is that when the capacity of the filling machine is reduced during operation, and hence when the conveying speed of the conveying means is reduced, the arm that carries the spray nozzle must be pivoted in the conveying direction of the conveying means, so that unavoidably one or more of the containers is supplied with the stream of the liquid that induces foaming for a longer period of time than is acceptable for a satisfactory operation of the foaming apparatus, thus resulting in an over foaming of the liquid material in the containers.

SUMMARY OF THE INVENTION

It is an object of the present invention to improve a foaming apparatus of the aforementioned general type in such a way that on the one hand, to simplify the construction, and in particular to increase the operational reliability, mechanically movable parts are eliminated, and on the other hand, especially where the capacity of the filling machine is changed, i.e. where the conveying speed of the conveying means is changed, a satisfactory foaming of the liquid material in the containers is insured without over foaming.

BRIEF DESCRIPTION OF THE DRAWINGS

This object, and other objects and advantages of the present invention, will appear more clearly from the following specification in conjunction with the accompanying schematic drawings, in which:

FIG. 3 is a detailed plan view of a ring segment of the foaming apparatus, together with one of the control valves provided on this ring segment, which forms a distribution channel for the medium that induces foaming;

FIG. 4 is a side view of the ring segment of FIG. 3 taken in the direction of the arrow IV in FIG. 3;

DESCRIPTION OF PREFERRED EMBODIMENTS

Figure 1:
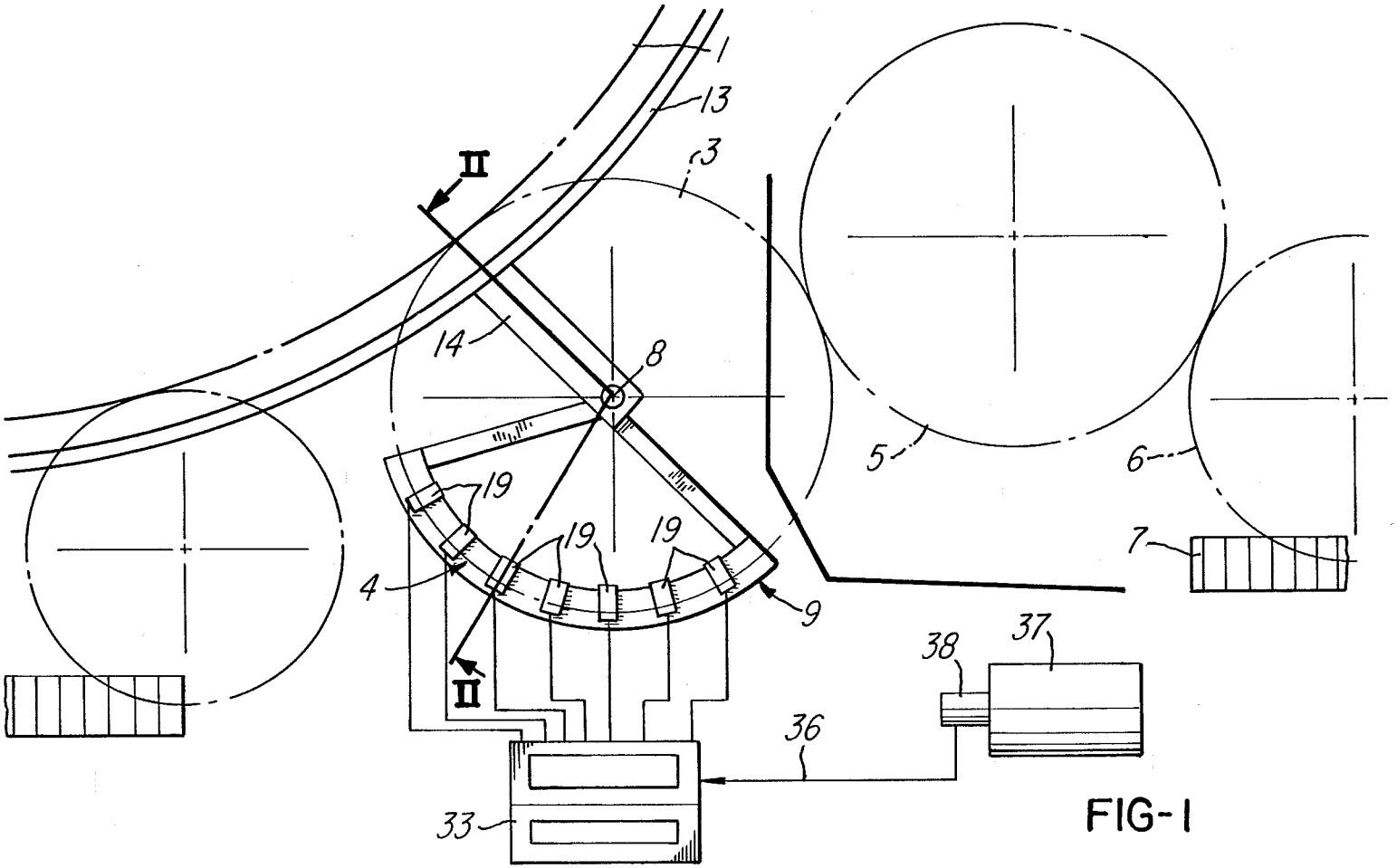
FIG. 1 is a plan view of a bottle-filling machine, a bottle-sealing device, and one exemplary embodiment of the inventive foaming apparatus, which is provided between the filling machine and the sealing device on a conveying means that is formed by a transport or transfer star.
Figure 2:
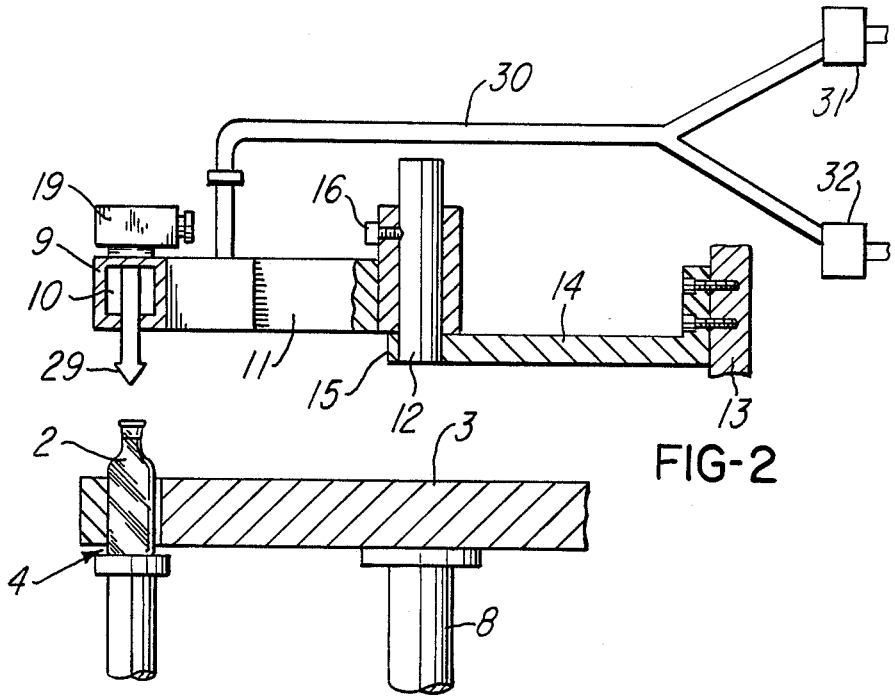
FIG. 2 is a cross-sectional view taken along the line II—II in FIG. 1.
Figure 5:
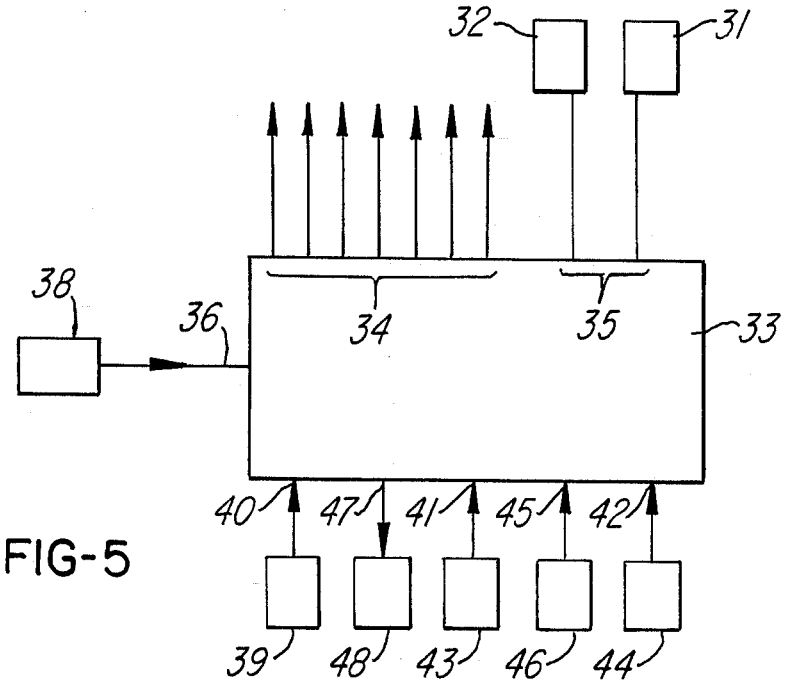
FIG. 5 is a view that shows a block diagram of a control device for controlling the inventive foaming apparatus.

The foaming apparatus of the present invention is characterized primarily in that the nozzle device comprises a plurality of individual spray nozzles that in the conveying direction of the conveying means are fixedly disposed one after the other above the path of movement of the containers, with the individual spray nozzles being adapted to communicate with a common supply channel for the medium that induces foaming, with each spray nozzle furthermore being provided with a separately controllable control valve for establishing the communication of the spray nozzles with the supply channel, whereby the control valves are operatively connected to the control device in such a way that the latter can select and open at least one control valve as a function of the conveying speed of the conveying means.

With the inventive foaming apparatus, with the aid of the control device initially basically as a function of the conveying speed of the conveying means, that control valve is selected and open that is associated with one of the nozzles that at this conveying speed has the distance from the sealing station of the sealing device that is required for an optimum foaming. In so doing, it is basically possible that the selected control valve be continuously open until selection and opening of another control valve by the control device, or that the selected control valve be opened for a short period of time at any time that a container moves by below the individual nozzle associated with this control valve. In principle, it is also possible with the aid of the control device to select several control valves, or a nozzle combination of several individual nozzles, that assure an optimum foaming.

With the inventive foaming apparatus, when the control device selects and opens the control valves, it preferably also takes into account the type of liquid material (type of beer), i.e. the ability of this liquid material to foam.

When the capacity of the filling machine changes during operation, and hence the conveying speed of the conveying means changes, the control device adapts the selection of the open control valve, and hence the distance of the spraying position, i.e. the respectively activated individual nozzle, from the sealing station in conformity with the changed conveying speed to achieve an optimum foaming When the capacity of the filling machine increases, the control valves, which are preferably controlled by the machine cycle, are preferably advanced in an overlapping or superimposed manner, to increase the distance of the spraying position from the sealing station, in such a way that the container that at the time point of the advancement is located between the original and the new spraying positions, is still supplied with the medium that induces foaming from the individual nozzle of the original spraying position. With the inventive foaming apparatus, the medium that induces foaming is preferably a liquid.

When the capacity of the filling machine is reduced, the control valves are advanced in an inactive state, preferably over the time period of a machine cycle, for reducing the aforementioned distance. With these inventive measures, the advantage is obtained that not only with an increase but also with a reduction of the capacity of the filling machine, each container is reliably supplied with the stream of the medium that induces foaming, but is supplied only one time with such a stream.

It is furthermore possible with the inventive foaming apparatus to embody the control device in such a way that it automatically, or by appropriate manual inputs, also takes into account changing operating conditions, such as fluctuations in pressure and temperature, during the selection of control valves.

Further specific features of the present invention will be described in detail subsequently.

Referring now to the drawings in detail, shown is a conventional bottle-filling machine 1 of which, for ease of illustration, only the bottle table or rotor, which rotates about a vertical axis, is illustrated. This bottle table or rotor serves for filling the bottles 2 with an effervescent or foamable liquid material, and preferably for filling the bottles 2 with beer. Provided where the bottles leave the filling machine 1 is a transport or transfer star 3 that rotates about a vertical axis synchronously with the bottle-filling machine 1. The transport or transfer star 3 feeds the filled but not-yet-sealed bottles 2, which are disposed on a conveying section or means 4 that is formed by a partial circle, one after the other to a bottle-sealing device 5 that is provided with a sealing station. From this bottle-sealing device 5, the sealed bottles are conveyed further via a discharge star 6 to a withdraw mechanism 7. The transfer star 3, which forms the conveying means 4 for the upright bottles 2, the bottle-sealing device 5, the discharge star 6, and the withdrawl mechanism 7 also have the conventional construction known for these elements.

A ring segment 9 is provided above the conveying means 4 formed by the transfer star 3, i.e. above the path of movement of the bottles 2 that are conveyed in an upright state on this conveying means 4 from the bottle-filling machine 1 to the bottle-sealing machine 5. In particular, the ring segment 9 is disposed vertically above the mouth of the bottles 2 on the conveying means 4 concentric to the axis 8 about which the transfer star 3 rotates. Formed in the ring segment 9 is a distribution channel 10 that extends over the entire length of the ring segment 9 and that is closed off at both ends of the ring segment 9.

Each end of the ring segment 9 is secured to one end of a support arm 11 that extends radially relative to the axis 8. The other ends of the support arms 11 are connected to one another as well as to a holding pin 12, the axis of which is disposed at right angles to the horizontal plane formed by the ring segment 9 and the support arms 11; the holding pin 12 projects upwardly beyond the support arms 11.

A carrier 14 is provided on a stationary machine part, for example on a control ring 13 of the bottle-filling machine 1. This carrier 14 is provided with a horizontal support arm 15 that is disposed over the transfer star 3, with the free end of the support arm 15 extending to the region of the axis 8. This free end of the support arm 15 is provided with a bearing hole into which the holding pin 12 extends from below, and in which the pin 12 is held in a suitable manner. The axis of the bearing hole provided in the support arm 15 for receiving the pin 12 coincides with the axis 8. The length of the support arms 11, and the radius of curvature of the ring segment 9, are such that the entire length of the latter is disposed in the manner described over the conveying means 4 and over the path of movement of the mouths of the bottles 2 as they move along the conveying means 4. As a result of the connection between the carrier 14 and the support arms 11 formed by the pin 12, the ring segment 9 by being pivoted about the axis 8, can be adjusted into a position that is optimum for the operation of the foaming apparatus. A holding or clamping screw 16 that is provided on the free end of the support arm 15 and cooperates with the pin 12 serves for arresting the ring segment 9 in this optimum operating position of the foaming apparatus.

Provided on the upper side 9' (visible in FIG. 3) and on the underside 9'' (not visible in FIG. 3) of the ring segment 9, which when viewed in a cross-sectional plane that extends radial to the axis 8 as a square or rectangular outer contour, are a plurality of holes 17 and 18 that extend from the outside into the distribution channel 10, which also has a square or rectangular cross-sectional shape. When viewed in the vertical direction, each hole 17 on the upper side 9' is aligned, i.e. is coaxial, with a hole 18 on the underside 9'', so that the holes 17 and 18 form respective pairs of holes, a total of seven of which, corresponding to the positions I to VII in FIG. 3, are provided in the illustrated embodiment.

Figure 6:
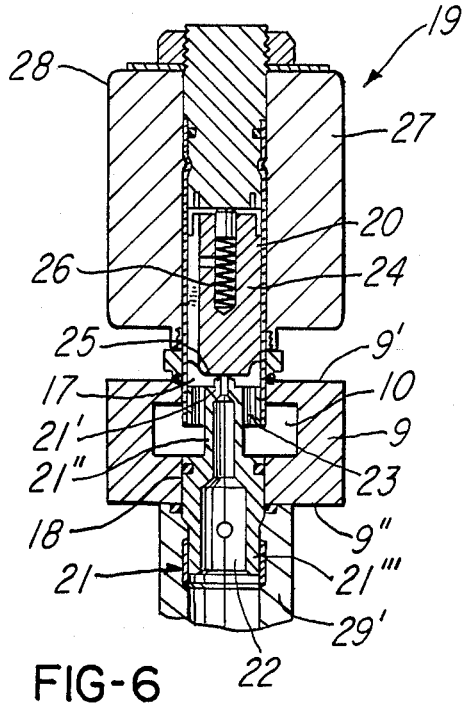
FIG. 6 is a detailed cross-sectional view through the ring segment and through one of the control valves on this ring segment.

A respective control valve 19, formed by a solenoid valve, is provided on the ring segment 9 on each pair of bores formed by two bores 17 and 18. As shown in FIG. 6, this control valve 19 essentially comprises a tubular valve element 20, which is tightly closed off at its upper end, and a sleeve-like valve element 21, the upper end of which extends into the lower end of the valve element 20, where it is secured; the two valve elements 20 and 21 are coaxially arranged. The valve element 21 forms a channel 22 that is open at the upper and lower ends of the valve element 21. In the region of what in FIG. 6 is its upper end, the valve element 21 is provided with a portion 21' having an outer diameter that corresponds to the inner diameter of the valve element 20. By means of this portion 21', which extends into the open lower end of the valve element 20, the valve element 21 is held on the valve element 20. Connected to the bottom of the portion 21' is a portion 21'' that has a reduced outer diameter. Connected to the bottom of the portion 21'' is a further portion 21''' that has an outer diameter that is equal to the outer diameter of the valve element 20. Plural auxiliary through channels 23 are provided that extend parallel to the channel 22 and are located radially outwardly from the chamber 22 in the portion 21'. The upper end of the valve element 21, as seen in FIG. 6, forms a valve seat for the seating seal 25 that is provided on the underside of a valve body 24, with the valve seat surrounding the opening of the channel 22 at that location. The valve body 24 is disposed in the valve element 20 in such a way as to be movable in the axial direction of the latter. The valve body 24 is preloaded by a compression spring 26 into a position in which the seating seal 25 rests against the aforementioned valve seat and hence closes off the upper end of the channel 22. When the magnet coil or solenoid 27 of the control valve 19 is energized, the valve body 24 is moved upwardly against the compression spring 26 to open the valve, i.e the upper end of the channel 22. The control valve 19, with the valve elements 20 and 21 that project beyond the underside of the housing 28 that accommodates the solenoid 27, is pushed from above into the pair of holes formed by the two holes 17 and 18 in such a way that the lower end of the valve element 20 extends through the hole 17 into the distribution channel 10, with this end as well as the portion 21'' of the valve element 21 being disposed in the distribution channel 10. The portion 21''' of the valve element 21 projects through the hole 18 and partially beyond the underside 9'' of the ring segment 9. Appropriate seals assure that the distribution channel 10 is sealed toward the outside at the holes 17 and 18. Secured to that end of the portion 21''' that projects beyond the underside 9'' of the ring segment 9 is a connector 29' that is formed by a vertical tubular element. The upper end of the connector 29' opens into the channel 22, and the lower end of the connector 29' opens into a discharge or nozzle opening of a spray nozzle 29. The nozzle opening of the spray nozzle 29 is directed vertically downwardly onto the path of movement of the mouths of the bottles 2. By energizing the solenoid 27, i.e. by opening the control valve 19, a connection for flowing medium is established between the distribution channel 10 and the nozzle opening of the nozzle 29. In particular, this connection is established via the auxiliary channels 23, the valve seat that has been freed from the seating seal 25, and the channel 22.

All of the control valves 19, which are provided on the pairs of holes formed by the holes 17 and 18, are embodied in the same manner as described above, and communicate with a respective spray nozzle 29.

The distribution channel 10 is connected to a line 30 for the supply of a liquid for inducing foaming, with this liquid being under pressure. The liquid for inducing foaming is preferably water, but it is also possible to use as a liquid medium the same liquid material with which the bottles 2 are filled. As a function of the type of liquid material with which the bottles are filled, i.e. as a function of the ability of this material to foam, as well as, for example, a function of the capacity of the bottle-filling machine 1, the pressure of the liquid for inducing foaming that is supplied via the line 30 can be variously selected or set. In the illustrated embodiment, the liquid for inducing foaming can be supplied to the line 30 via a valve 31 at a pressure that can be set or regulated between eight to ten bar, or can be supplied to the line 30 via a valve 32 at a pressure that can be regulated or set between twenty and thirty bar.

To control the control valve 19, an electronic control device 33 is provided that preferably includes a process computer having a microprocessor. The control device 33 has a number of outputs 34, with this number corresponding to the number of control valves 19; each output 34 is connected to a control valve 19. The control device 33 is furthermore provided with two outputs 35, each of which is connected to one of the valves 31 and 32. Via an input 36, the control device 33 is supplied with a pulse signal that forms a first control signal, with the frequency of this pulse varying as a function of the capacity of the bottle-filling machine 1 (filled bottes 2/unit of time) and hence also as a function of the conveying speed of the transfer star 3. The cycle of the bottle-filling machine 1 is also supplied to the control device 33 via this pulse signal, which is derived from a pulse transmitter 38 provided on the regulatable drive mechanism 37 of the filling machine 1. In addition, a data input 39 is provided that is connected to the control device 33 via an input 40. Via the data input 39, a second control signal, which conforms to a specific capacity of the bottle-filling machine 1, can be manually introduced into the control device 33.

The control device 33 also has two further inputs 41 and 42, with the input 41 being connected to a data input 43, and the input 42 being connected with a data input or adjustment device 44. Via the data input 43, a third control signal is supplied to the control device 33. This third control signal takes into account the ability of the respective liquid material to foam, i.e. the varying types of material (for example different types of beer). With the aid of the data input 44, i.e. with the aid of a fourth control signal delivered by this input, it is possible, via appropriate control of the valves 31 and 32, to supply the liquid that induces foaming to the distribution channel 10 at a pressure that is either in a low pressure range or in a high pressure range, whereby the control mechanism is embodied in such a way that in the two pressure ranges either respective fixed predetermined pressures are used, or the pressure is adjusted to an optimum value by the control device 33 in conformity to the capacity of the bottle-filling machine 1 and/or in conformity to the type of material being dispensed into the bottles, i.e. the ability of this material to foam.

A data input or adjustment device 46 is connected to a further input 45 of the control device 33. This data input 46 delivers a fifth control signal to the control device 33 for initiating and carrying out a cleaning program, especially for the foaming apparatus.

In addition, an indicator 48 is connected to an output 47 of the control device 33. The indicator 48 displays or records the respective operating state of the control device 33, especially the control valve 19 that has been selected at any given time by this control device. The indicator 48 also preferably displays or records possible interruptions in operation, the measures that are to be undertaken by operating personnel to correct such disruptions, the data or operating conditions fed in at the data inputs 39, 43, 44, and 46, the actual capacity of the bottle-filling machine, etc.

The method of operation of the inventive foaming apparatus is, by way of example, described as follows:

The bottles 2, which have been filled with liquid material, are fed one after another to the sealing or capping device 5 via the conveying means 4, which is formed by the transfer star 3. In order prior to sealing of the bottles 2 to drive out from the latter the residual air that inevitably remains during filling, the control valve 19 of one of the nozzles 29, which are disposed one after the other in the conveying direction of the conveying means 4, is opened in response to a control signal delivered with the aid of the control device 33. As a result, this nozzle 29, which then forms the spray position of the foaming apparatus, discharges, under pressure, a fine stream of the liquid that induces foaming. As each bottle 2 passes below this nozzle 29, the aforementioned stream enters the material that is present in these bottles 2, and causes this material to foam. The thus-formed foam drives the residual air out of the pertaining bottle before the latter is sealed at the closure station of the sealing device 5. To prevent the material in the bottles 2 from foaming over, and hence in particular to prevent a loss of material from the bottles 2, the optimum desire is that each bottle 2, after passing the spraying position, reaches the closure station of the bottle-sealing device 5 just when the head of the material foam is right at the mouth of the bottle 2, so that foaming-over has not yet occurred, but all of the residual air has been driven out of the bottle. Since in order to accomplish this a certain amount of time (foaming time) is required, in response to the capacity of the filling machine 1 fed to the data input 39, as well as upon consideration of the values fed to the data inputs 44 and 46, but also upon consideration of the first control signal delivered from the pulse transmitter 38, that one of the control valves 19 is selected and opened by the control device 33 that has a distance from the sealing device 5 that assures this optimum foaming time, with this selection of the control valve 19 taking into account the conveying speed of the conveying means 4. Thus, at a given pressure of the liquid that is to induce foaming, where the capacity of the bottle-filling machine 1 is low, a control valve 19 is selected and opened by the control device 33 that in the conveying direction of the conveying means 4 is not very far from the sealing device 5, whereas where the capacity of the bottle-filling machine 1 is greater, a control valve 19 is selected and opened that has an appropriately greater distance from the bottle-sealing device 5. In other words, at a given pressure of the liquid that induces foaming, the distance of the spraying position from the closure station of the bottle-sealing device 5 increases as the capacity of the bottle-filling machine 1 increases, and vice versa. If the capacity of the bottle-filling machine 1 varies during operation, a correction of the spraying position is automatically effected via the first control signal delivered by the pulse transmitter 38, by advancing the control valves 19, i.e. by closing the control valve 19 that was open up to now and opening a different control valve 19, in such a way that the distance between the spraying position and the sealing device 5, by taking into consideration the altered capacity of the bottle-filling machine, again assures an optimum foaming time. When the capacity of the bottle-filling machine 1 is increased, the control valves 19 that are controlled by the machine cycle are superimposed so as to increase the distance, i.e. the control valves are advanced in such a way that all of the bottles 2 that at the point of time of advancement are disposed between the new and original spraying positions are still supplied with the liquid that induces foaming at the original spraying position. When the capacity of the bottle-filling machine 1 is reduced, the control valves 19, and hence the spraying position, are held back inactive beyond the time of the machine cycle so as to reduce the distance.

Since the time required for an optimum foaming, i.e. the spraying position, is also a function of the type of liquid material in the bottles, i.e. the ability of this material to foam, when the selection on the control valve 19 is made by the control device 33, the type of material (type of beer) fed in at the data input 43 is also taken into account. In other words, at a given pressure of the liquid that induces foaming, and at a given capacity of the bottle-filling machine 1, the control device 33 selects and opens the control valves 19 in such a way that for a material that has a great ability to foam, the spraying position is closer to the sealing device 5, and where the material has a lesser ability to foam, the spraying position is further from the closure position of the bottle-sealing device 5.

Since furthermore as a function of the respective liquid material in the bottles, and the ability of this material to foam, a different pressure may be required for the liquid that induces foaming and that is discharged from the opened nozzle 29, this pressure can be adjusted by the control device 33 with the aid of the data input 44 accompanied by appropriate control of the valves 31 and 32, whereby these inputs at the data input 44 are preferably also taken into consideration by the control device 33 during selection of the spraying position. The described control procedures are preferably controlled by a computer from the control device 33, and are undertaken in conformity with values stored in this device.

In FIG. 3 the Roman numerals I–VII indicate the positions of the various control valves 19, and thus of the associated nozzles 29, along the ring segment 9 and hence along the conveying means 4. In this connection, the control valve 19 and associated nozzle 29 that correspond to the position I have the greatest distance (angular spacing) from the sealing device 5, and the control valve 19 and associated nozzle 29 that correspond to the position VII have the least distance from the bottle-sealing device 5. Pursuant to one specific embodiment of the inventive foaming apparatus, where the pressure of the liquid that induces foaming is approximately ten bar, and with a specific type of beer, the control valves 19 provided at the aforementioned positions are selected by the control device 33 as a function of the capacity of the bottle-filling machine 1 in conformity to the following table:

| Capacity of bottle-filling machine in bottles/hour | Position of selected and opened control valve |
|---|---|
| 50,000 | I |
| 48,000 | II |
| 42,000 | III |
| 38,000 | IV |
| 33,000 | V |
| 28,000 | VI |
| 1,000 | VII |

The present invention has been described in conjunction with one exemplary specific embodiment. It is to be understood that changes and modifications are possible without thereby deviating from the basic concept of the invention. For example, in principle it is also possible to dispense with the data input 39, i.e. the input of the capacity of the bottle-filling machine 1, and to exclusively feed to the control device 33 the first control signal derived from the pulse transmitter 38 for taking into account the capacity of the bottle-filling machine 1.

The present invention is, of course, in no way restricted to the specific disclosure of the specification and drawings, but also encompasses any modifications within the scope of the appended claims.

What we claim is:

1. In a foaming apparatus for driving out the residual air from containers, especially bottles, that are filled with a liquid foamable material that can be caused to foam, with said apparatus including a nozzle mechanism that is disposed above a conveying means that feeds not-yet-sealed containers, which are filled with said liquid foamable material, in an upright state to a sealing device that is provided with a sealing station, whereby at a spraying position that in the conveying direction of said conveying means is located prior to said sealing station, said nozzle mechanism introduces a stream of gaseous or liquid medium that induces foaming, preferably a stream of water or a stream of said liquid foamable material with which said containers are filled, into said liquid foamable material in those containers that move past below said nozzle mechanism, for the purpose of foaming said liquid foamable material in said containers and driving out the residual air in those containers via the thus-formed foam, and with said apparatus also including a control device for varying the distance of said spraying position from said sealing station as a function of the conveying speed of said conveying means, the improvement wherein:

said nozzle mechanism comprising a plurality of individual spray nozzles that in the conveying direction of said conveying means are fixedly disposed one after the other above the path of movement of said containers on said conveying means, with each of said spray nozzles being adapted to communicate with a common supply channel for said medium that induces foaming, with each of said spray nozzles furthermore being provided with a separately controllable control valve for establishing or breaking said communication of that spray nozzle with said supply channel, whereby said control valves are operatively connected to said control device in such a way that the control device at any given time can select and open at least one of said control valves as a function of the conveying speed of said conveying means, said control device including a data input or adjustment device at which the type of liquid foamable material with which said containers are filled is preset, with selection and opening of a given control valve by said control device taking into consideration said preset type of liquid foamable material.

2. A foaming apparatus according to claim 1, in which prior to first operation said nozzle mechanism is adjustable in the direction of said conveying means.

3. A foaming apparatus according to claim 2, in which said conveying means is formed by a transport star that rotates about a vertical axis, and said individual spray nozzles are disposed on an arch segment that is concentric to said axis about which said transport star rotates.

4. A foaming apparatus according to claim 3, in which said arch segment is a ring segment that forms said common supply channel and has an underside on which said individual spray nozzles are disposed.

5. A foaming apparatus according to claim 4, in which accompanying said nozzle mechanism adjustment, said ring segment is adjustable in the direction of said transport star by being supported by a carrier in such a way as to be pivotable about said axis about which said transport star rotates.

6. A foaming apparatus according to claim 1, which includes a pulse transmitter for supplying to said control device a control signal that corresponds to the conveying speed of said conveying means.

7. A foaming apparatus according to claim 1, in which said control device includes a data input or adjustment device at which a conveying speed of said conveying means is preset, with selection and opening of a given one of said control valves by said control device taking into consideration said preset conveying speed.

8. In a foaming apparatus for driving out the residual air from containers, especially bottles, that are filled with a liquid foamable material that can be caused to foam, with said apparatus including a nozzle mechanism that is disposed above a conveying means that feeds not-yet-sealed containers, which are filled with said liquid foamable material, in an upright state to a sealing device that is provided with a sealing station, whereby at a spraying position that in the conveying direction of said conveying means is located prior to said sealing station, said nozzle mechanism introduces a stream of gaseous or liquid medium that induces foaming, preferably a stream of water or a stream of said foamable liquid material with which said containers are filled, into said liquid foamable material in those containers that move past below said nozzle mechanism, for the purpose of foaming said liquid foamable material in said containers and driving out the residual air in those containers via the thus-formed foam, and with said apparatus also including a control device for varying the distance of said spraying position from said sealing station as a function of the conveying speed of said conveying means, the improvement wherein:

said nozzle mechanism comprises a plurality of individual spray nozzles that in the conveying direction of said conveying means are fixedly disposed one after the other above the path of movement of said containers on said conveying means, with each of said spray nozzles being adapted to communicate with a fixedly disposed common supply channel for said medium that induces foaming, with each of said spray nozzles furthermore being provided with a separately controllable control valve for establishing or breaking said communication of that spray nozzle with said supply channel, whereby said control valves are operatively connected to said control device in such a way that the control device at any given time can select and open at least one of said control valves as a function of the conveying speed of said conveying means, said plurality of individual spray nozzles, rather than always being opened, being controlled dependent upon said apparatus' operation and output so as to permit a constant and invariable foaming of the liquid foamable material to drive out residual air in the containers via the thus-formed foam.

* * * * *